US009707472B2

(12) United States Patent
Glass

(10) Patent No.: US 9,707,472 B2
(45) Date of Patent: Jul. 18, 2017

(54) TETHERED BALL TOY

(76) Inventor: Don Glass, Duluth, GA (US)

( * ) Notice: Subject to any disclaimer, the term of this patent is extended or adjusted under 35 U.S.C. 154(b) by 136 days.

(21) Appl. No.: 13/473,641

(22) Filed: May 17, 2012

(65) Prior Publication Data

US 2012/0295513 A1 Nov. 22, 2012

Related U.S. Application Data

(60) Provisional application No. 61/487,248, filed on May 17, 2011.

(51) Int. Cl.

| | |
|---|---|
| ***A63H 1/06*** | (2006.01) |
| ***A63F 7/40*** | (2006.01) |
| *A63F 9/24* | (2006.01) |

(52) U.S. Cl.

CPC ..... *A63F 7/40* (2013.01); *A63F 2007/4087* (2013.01); *A63F 2009/2451* (2013.01)

(58) Field of Classification Search

USPC ..... 446/220, 228, 247, 252; 473/570, 571, 473/576

See application file for complete search history.

(56) References Cited

U.S. PATENT DOCUMENTS

| | | | | | |
|---|---|---|---|---|---|
| 665,980 | A | * | 1/1901 | Roche | 446/247 |
| 672,099 | A | * | 4/1901 | Jackson | 473/576 |
| 1,331,971 | A | * | 2/1920 | Adler | 446/247 |
| 1,858,145 | A | | 5/1932 | Felardo | |
| 1,915,868 | A | * | 6/1933 | Rogers | 446/247 |
| 1,932,943 | A | * | 10/1933 | Smith | 446/247 |
| 2,125,815 | A | | 8/1938 | Rowell | |
| 2,991,585 | A | | 7/1961 | Drees | |
| 3,093,376 | A | | 6/1963 | Terry | |
| 3,608,235 | A | * | 9/1971 | Harton | 446/247 |
| 3,693,286 | A | * | 9/1972 | Marcotti | 446/266 |
| D309,475 | S | * | 7/1990 | Salehzadeh et al. | D21/466 |
| D326,484 | S | * | 5/1992 | Nwoke | D21/466 |
| 5,236,383 | A | * | 8/1993 | Connelly | 446/219 |
| 5,492,335 | A | * | 2/1996 | Videnov | 473/576 |
| 6,887,188 | B1 | * | 5/2005 | Davies | 482/82 |
| 2002/0137582 | A1 | * | 9/2002 | Yu | 473/570 |

FOREIGN PATENT DOCUMENTS

| | | |
|---|---|---|
| GB | 625695 | 7/1949 |

* cited by examiner

*Primary Examiner* — Kurt Fernstrom
(74) *Attorney, Agent, or Firm* — Crose Law LLC; Bradley D. Crose

(57) ABSTRACT

A tethered ball toy is disclosed. In at least one embodiment, the tethered ball toy includes a handle, first and second tethers, first and second balls, a tether cavity configured to receive and secure the tethers, and first and second fasteners to secure the tethers to the balls. In at least one embodiment, each ball is tethered at equal distance to the handle by a tether cord and configured to be set in motion and subsequently to collide with one another, thereby remaining in motion through a basic level of acquired skill in use of the tethered ball toy. In at least one embodiment, a ball is filled with one or more inert gases. In at least one embodiment, the tethered ball toy includes lights within each ball that illuminate upon impact.

17 Claims, 10 Drawing Sheets

TETHERED BALL TOY

CROSS-REFERENCE TO RELATED APPLICATION(S)

The present non-provisional patent application claims the benefit of priority of U.S. Provisional Patent Application No. 61/487,248, which is entitled "A TETHERED BALL TOY", which was filed on May 17, 2011, and which is incorporated in full by reference herein.

FIELD OF THE INVENTION

The technology described herein relates generally to toys, whirling toys, balls, and swinging ball toys. More specifically, this technology relates to a toy having a pair of tethered balls suspended from a handle, each ball tethered at equal distance to the handle by a cord and configured to be set in motion and subsequently to collide with one another, thereby remaining in motion through a basic level of acquired skill in use of the toy. Furthermore, this technology relates to a ball filled with one or more gases, such as compressed air or helium. Still furthermore, this technology relates to a ball have a light within the ball, and wherein the light can illuminate upon impact.

BACKGROUND OF THE INVENTION

Balls, such as those for amusement and sport, are known in the background art. Balls for amusement and sport are nearly ubiquitous. Such a ball typically is utilized by the operator to provide a means by which to play a game or a means by which to be amused. Within sports, balls are known for playing games such as basketball, football, soccer, baseball, and so forth. For amusement, balls and ball toys are known to include paddle toys, paddle balls, rotating balls, whirling toys, swing ball toys, balls attached to struts, and so forth.

By way of example, ball toys are known wherein one or more balls are configured for impact with an item, such as a paddle, or another ball. However, numerous practical, ergonomic, and safety issues exist with these known devices.

Related issued utility patents known in the art include the following. U.S. Pat. No. 1,858,145, issued to Felardo on Oct. 25, 1930, discloses a toy of the whirligig type. U.S. Pat. No. 2,125,815, issued to Rowell on Oct. 25, 1930, discloses a whirling toy. GB Patent No. 625,695, issued to Felardo on Jul. 1, 1949, discloses an improvement in or relating to toys. U.S. Pat. No. 2,991,585, issued to Drees on Apr. 17, 1959, discloses swinging ball toys. U.S. Pat. No. 3,093,376, issued to Terry on Dec. 30, 1960, discloses a paddle-ball toy. U.S. Pat. No. 3,693,286, issued to Marcotti on Sep. 26, 1972, discloses an amusement toy.

SUMMARY OF THE INVENTION

In various exemplary embodiments, the technology described herein provides a toy having a pair of tethered balls suspended from a handle, each ball tethered at equal distance to the handle, each by a separate cord, and each configured to be set in motion and subsequently to collide with one another, thereby remaining in motion through a basic level of acquired skill in use of the toy.

The tethered ball toy is configured to provide amusement safely to both the operator and any onlooker. The tethered ball toy also is configured to provide an optical illusion while in use and while remaining in motion. The tethered ball toy further is configured as a noise making device as the balls of the device collide at various intervals in a circle. The tethered ball toy further is adapted to provide amusement to children, but is designed to be safe and fun for persons of all ages.

In at least one exemplary embodiment, the tethered ball toy includes: a handle; at least one tether coupled to the handle; and a pair of tethered balls coupled to the at least one tether and suspended from a distal end the handle, each ball tethered at equal distance along the at least one tether to the handle, and each ball configured to be set in motion by a continuous movement of the handle and subsequently to collide with one another, thereby remaining in motion through a basic level of acquired skill in use of the tethered ball toy.

In at least one embodiment, the tethered ball toy also includes: a cavity disposed within the handle and configured to receive a proximal end of the at least one tether, and configured to receive and store within the handle any excess length of the at least one tether.

In at least one embodiment, the tethered ball toy further includes: a swivel cylinder disposed within the cavity of the handle and opening at a distal end of the handle. The swivel cylinder is configured to receive a proximal end of the at least one tether, and configured to allow rotation of the at least one tether within the handle.

In at least one embodiment, the tethered ball toy also includes: a hollow end disposed at the proximal end of the handle. This configuration provides that the at least one tether is able to be pulled through the hollow end of the handle to adjust a length of the at least one tether.

In at least one embodiment, the at least one tether includes a pair of tethers, a first tether to tether a first ball to the handle, and a second tether to tether a second ball to the handle.

In at least one embodiment, the handle further comprises a hand grip.

In at least one embodiment, the tethered ball toy further includes: a first fastener and a second fastener. Each fastener is disposed upon and configured to securely hold one of the pair of tethered balls and couple to an end of the at least one tether.

In at least one embodiment, the tethered ball toy also includes: a first ring and a second ring. Each ring is coupled to one of the first fastener and the second fastener.

In at least one embodiment, the tethered ball toy further includes: a first ring channel and a second channel. The first ring channel is disposed within the first fastener and is configured to receive the first ring. The second ring channel is disposed within the second fastener and is configured to receive the second ring.

In at least one embodiment, the tethered ball toy also includes: a first swivel and a second swivel. The first swivel is coupled to the first ring at a distal end of the first swivel and is coupled to the at least one tether at a proximal end of the first swivel. The second swivel is coupled to the second ring at a distal end of the second swivel and is coupled to the at least one tether at a proximal end of the second swivel.

In at least one embodiment, the tethered ball toy further includes: a first clasp and a second clasp. The first clasp is coupled to a first end of the at least one tether and is configured to securely hold the first end looped through the first swivel. The second clasp is coupled to a second end of the at least one tether and is configured to securely hold the second end looped through the second swivel.

In at least one embodiment, the tethered ball toy also includes: a first light and a second light. The first light is disposed within a first ball of the pair of tethered balls. The second light is disposed within a second ball of the pair of tethered balls. The first and second lights are configured to illuminate upon impact when, while the tethered ball toy is in use, the first ball and the second ball collide, such that upon collision the impact causes the lights to illuminate.

In at least one embodiment, the at least one tether comprises a synthetic cord.

In at least one embodiment, the handle is defined as generally a long cylindrical shape having a grip.

In at least one embodiment, the pair of tethered balls includes a first ball and a second ball, each ball made of plastic.

In at least one embodiment, the pair of tethered balls includes a first ball and a second ball, each ball made of rubber.

In at least one embodiment, the pair of tethered balls includes a first ball and a second ball, each ball hollow and filled with an inert gas.

In at least one embodiment, the pair of tethered balls includes a first ball and a second ball, each ball hollow and filled with compressed air or helium.

In at least one embodiment, the pair of tethered balls includes a first ball and a second ball, each ball hollow and comprising a bladder. The bladder is filled with a first inter gas. An area surrounding the bladder and within the ball is filled with a second inert gas.

In at least one embodiment, the tethered ball toy is configured as a noise making device as the pair of tethered balls collide at various intervals in a circular pattern formed by the movement of the handle and balls.

The tethered ball toy is practiced by repeatedly raising and lowering the handle in a learned pattern that commences with a slight raising and lowering and then accelerates to a faster raising and lowering, thus causing the first ball and the second ball to move. As the motion of the handle continues with a practiced and acquired level of skill, the first ball and second ball will "collide" into one another.

Advantageously, the technology described herein provides for a safe amusement device for children and persons of all ages. Also advantageously, the tethered ball toy described herein provides for an optical illusion while in use and while remaining in motion. Further advantageously, the tethered ball toy described herein provides a noise making device as the balls of the device collide at various intervals in a circle.

Thus, there has thus been outlined, rather broadly, the features of the present invention in order that the detailed description that follows may be better understood, and in order that the present contribution to the art may be better appreciated. There are additional features of the invention that will be described and which will form the subject matter of the claims. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed are for the purpose of description and should not be regarded as limiting.

As such, those skilled in the art will appreciate that the conception, upon which this disclosure is based, may readily be utilised as a basis for the designing of other structures, methods, and systems for carrying out the several purposes of the present invention. It is important, therefore, that the claims be regarded as including such equivalent constructions insofar as they do not depart from the spirit and scope of the present invention.

Additional aspects and advantages of the present invention will be apparent from the following detailed description of an exemplary embodiment which is illustrated in the accompanying drawings.

DETAILED DESCRIPTION

In various exemplary embodiments, the technology described herein provides a toy having a pair of tethered balls suspended from a handle, each ball tethered at equal distance to the handle, each by a separate cord or tether, and each configured to be set in motion and subsequently to collide with one another repeatedly, thereby remaining in motion through a basic level of acquired skill in use of the toy.

Figure 1:
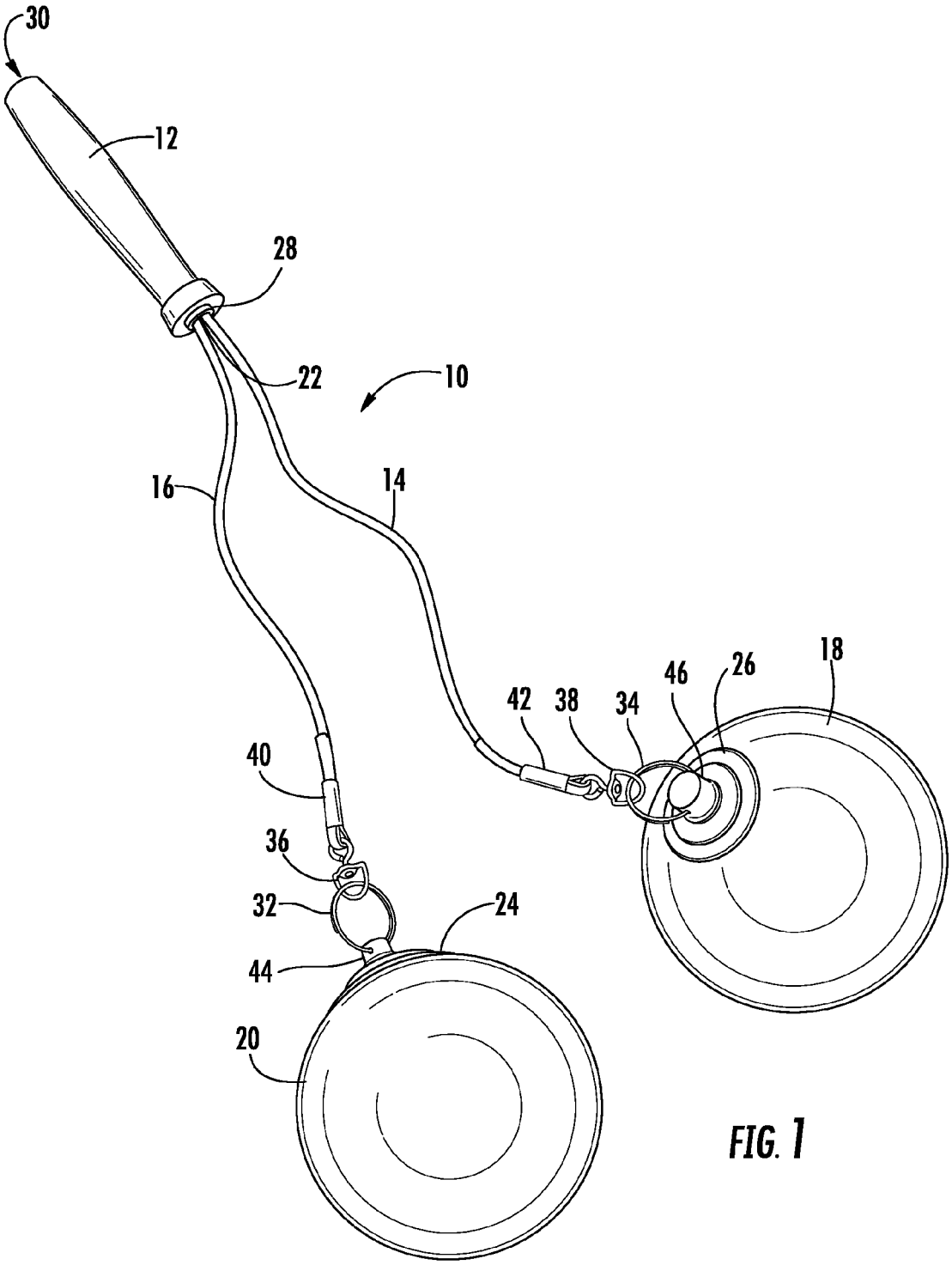
FIG. 1 is a front perspective view of a tethered ball toy, illustrating, in particular, the handle, the first and second tethers, first and second rings, first and second swivels, first and second clasps, swivel cylinder, the tether cavity, the first and second balls, and the first and second fasteners, according to an embodiment of the technology described herein.
Figure 2:
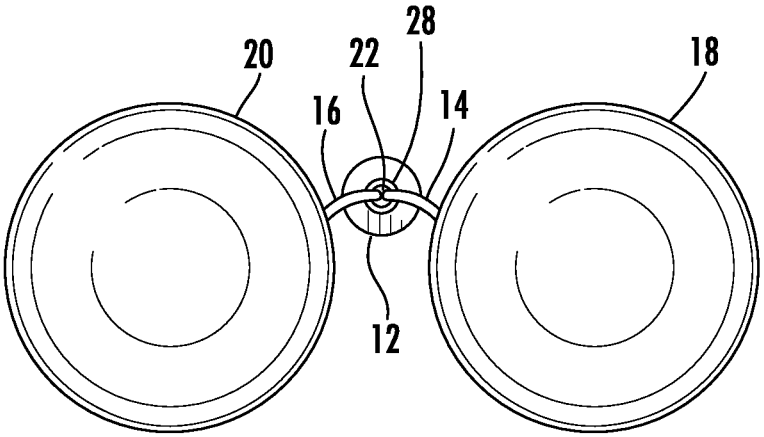
FIG. 2 is a bottom view of the tethered ball toy depicted in FIG. 1, illustrating, in particular, the two suspended balls in relation to the tethers and the handle and the swivel cylinder into which the first and second tethers feed into the handle and in which the first and second tethers can spin and move.
Figure 3:
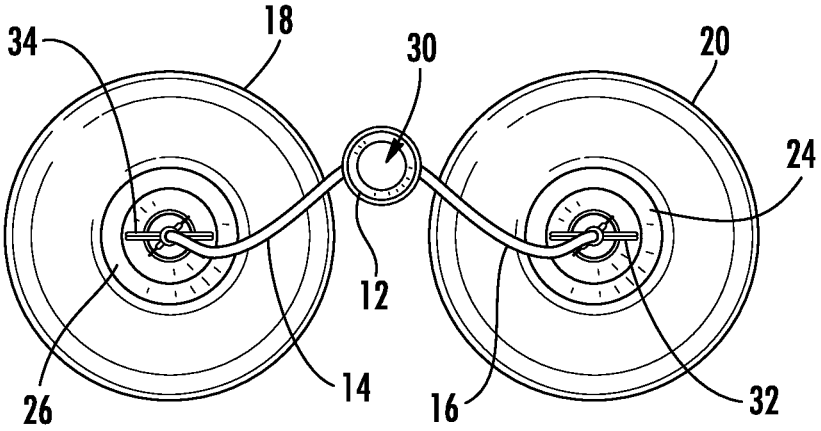
FIG. 3 is a top view of the tethered ball toy depicted in FIG. 1, illustrating, in particular, the two suspended balls in relation to the tethers and the handle and the hollow end of the handle to access and lengthen or shorten the first and second tethers such that the distance between the two suspended balls is operatively varied.
Figure 4:
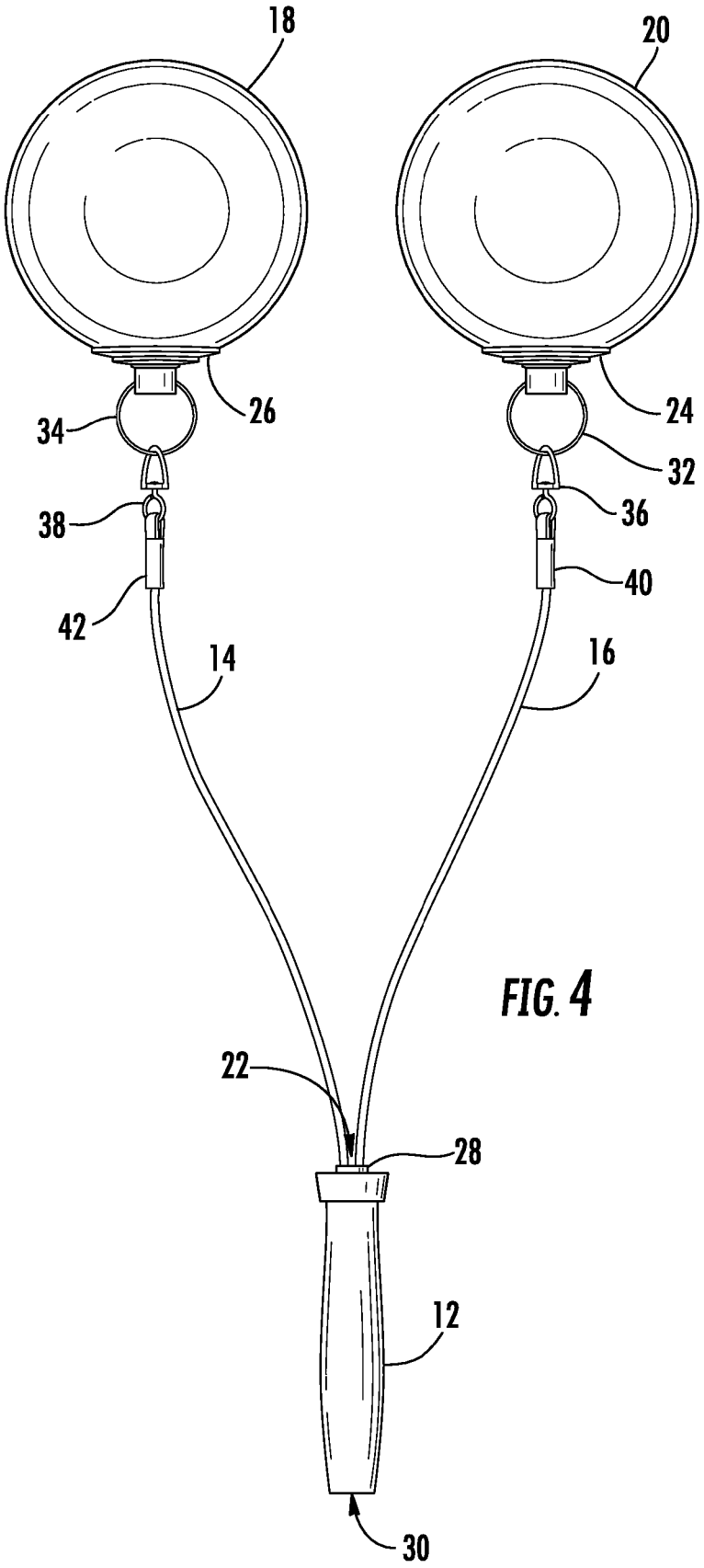
FIG. 4 is a first side view of the tethered ball toy depicted in FIG. 1, illustrating, in particular, the handle, the first and second tethers, first and second rings, first and second swivels, first and second clasps, swivel cylinder, and the first and second balls.
Figure 5:
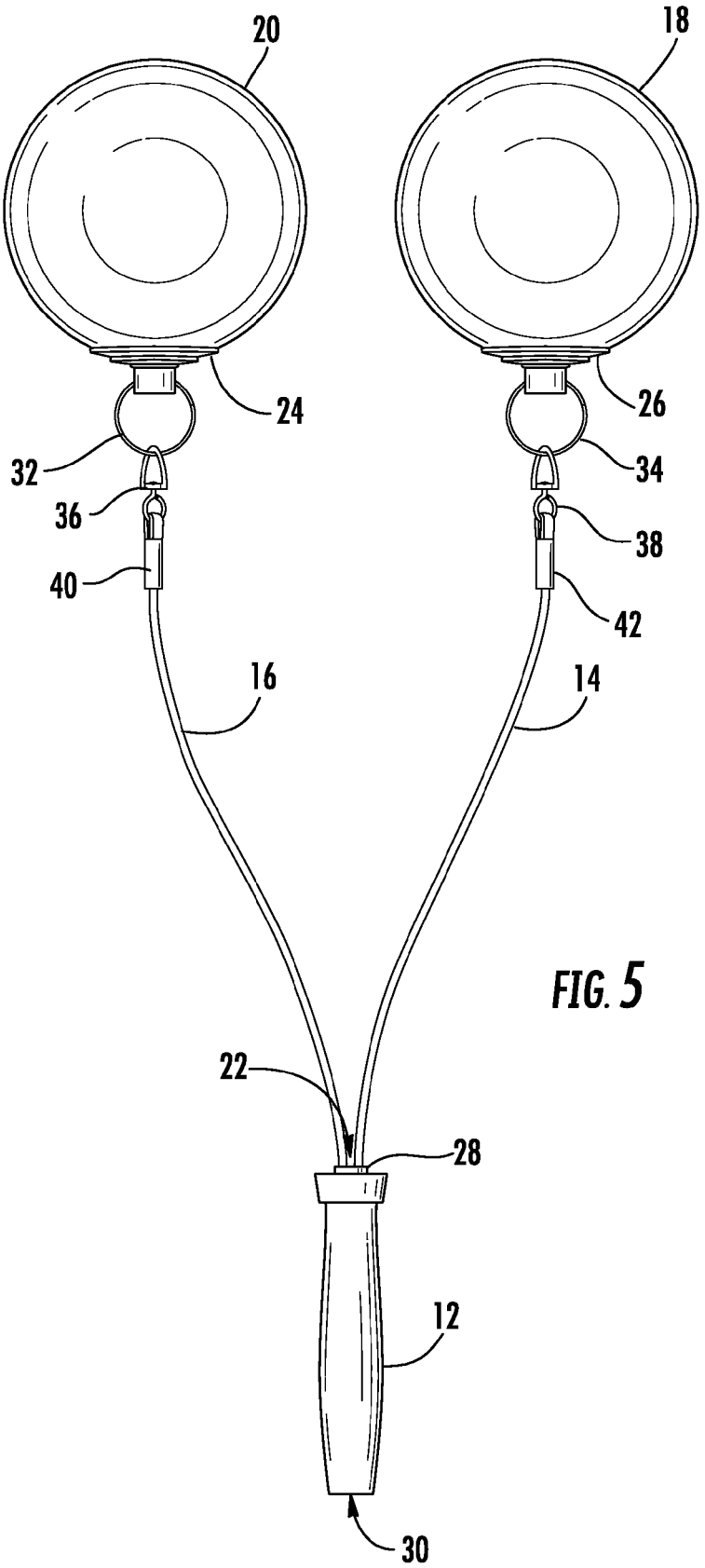
FIG. 5 is a second side view of the tethered ball toy depicted in FIG. 1, illustrating, in particular, the handle, the first and second tethers, first and second rings, first and second swivels, first and second clasps, swivel cylinder, and the first and second balls.
Figure 6:
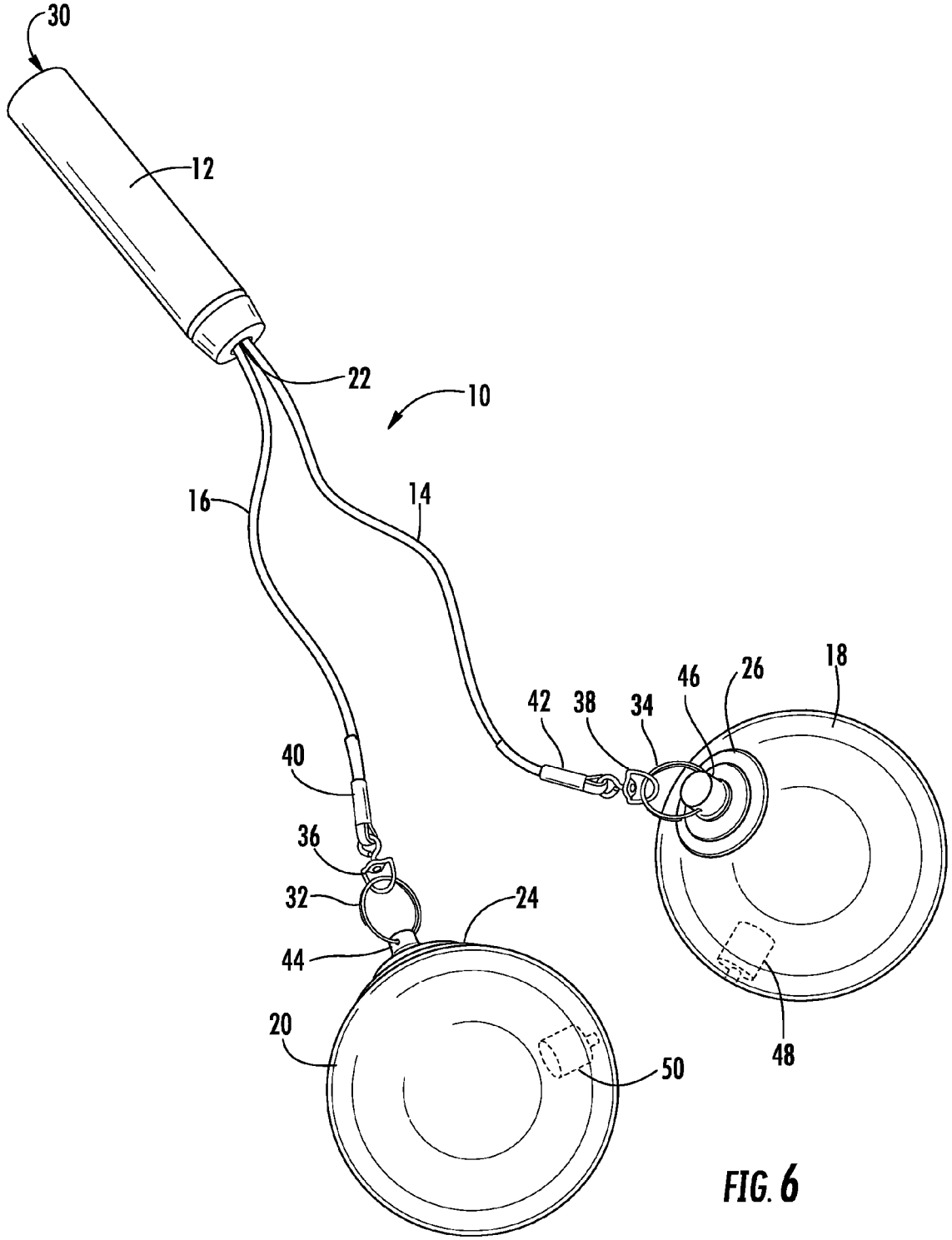
FIG. 6 is a front perspective view of a tethered ball toy, illustrating, in particular, the handle, the first and second tethers, first and second rings, first and second swivels, first and second clasps, swivel cylinder, the tether cavity, the first and second balls, first and second fasteners, and first and second lights within the two balls, according to an embodiment of the technology described herein.
Figure 7:
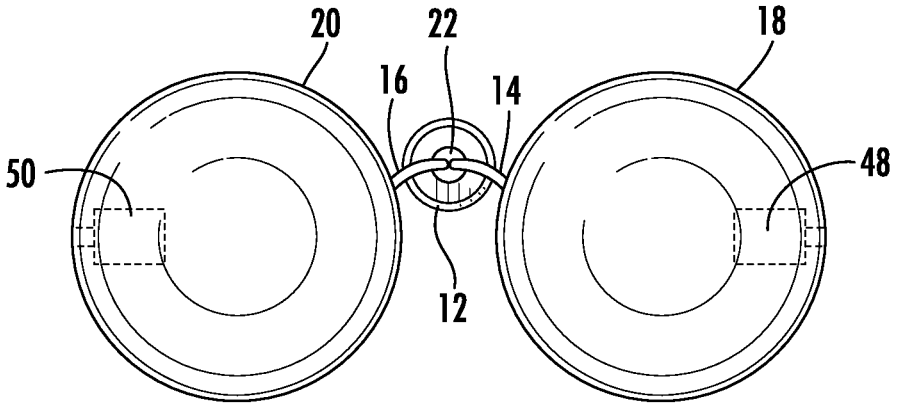
FIG. 7 is a bottom view of the tethered ball toy depicted in FIG. 6, illustrating, in particular, the two suspended balls in relation to the tethers and the handle and the swivel cylinder into which the first and second tethers feed into the handle and in which the first and second tethers can spin and move, and first and second lights within the two balls.
Figure 8:
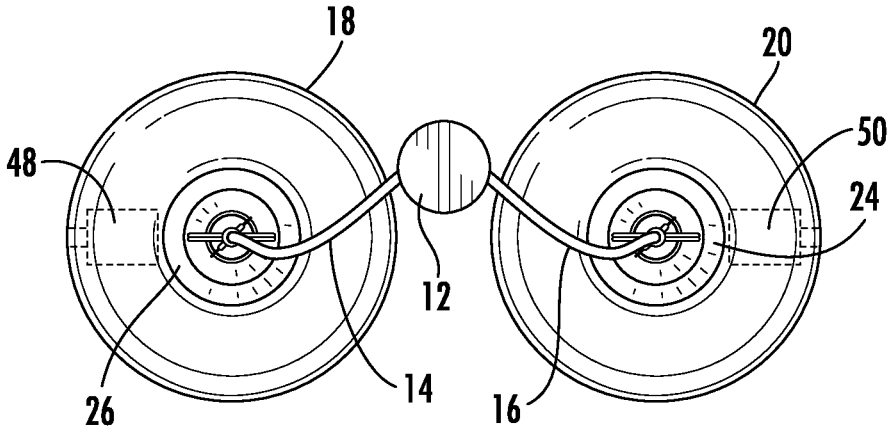
FIG. 8 is a top view of the tethered ball toy depicted in FIG. 1, illustrating, in particular, the two suspended balls in relation to the tethers and the handle and the hollow end of the handle to access and lengthen or shorten the first and second tethers such that the distance between the two suspended balls is operatively varied, and first and second lights within the two balls.
Figure 9:
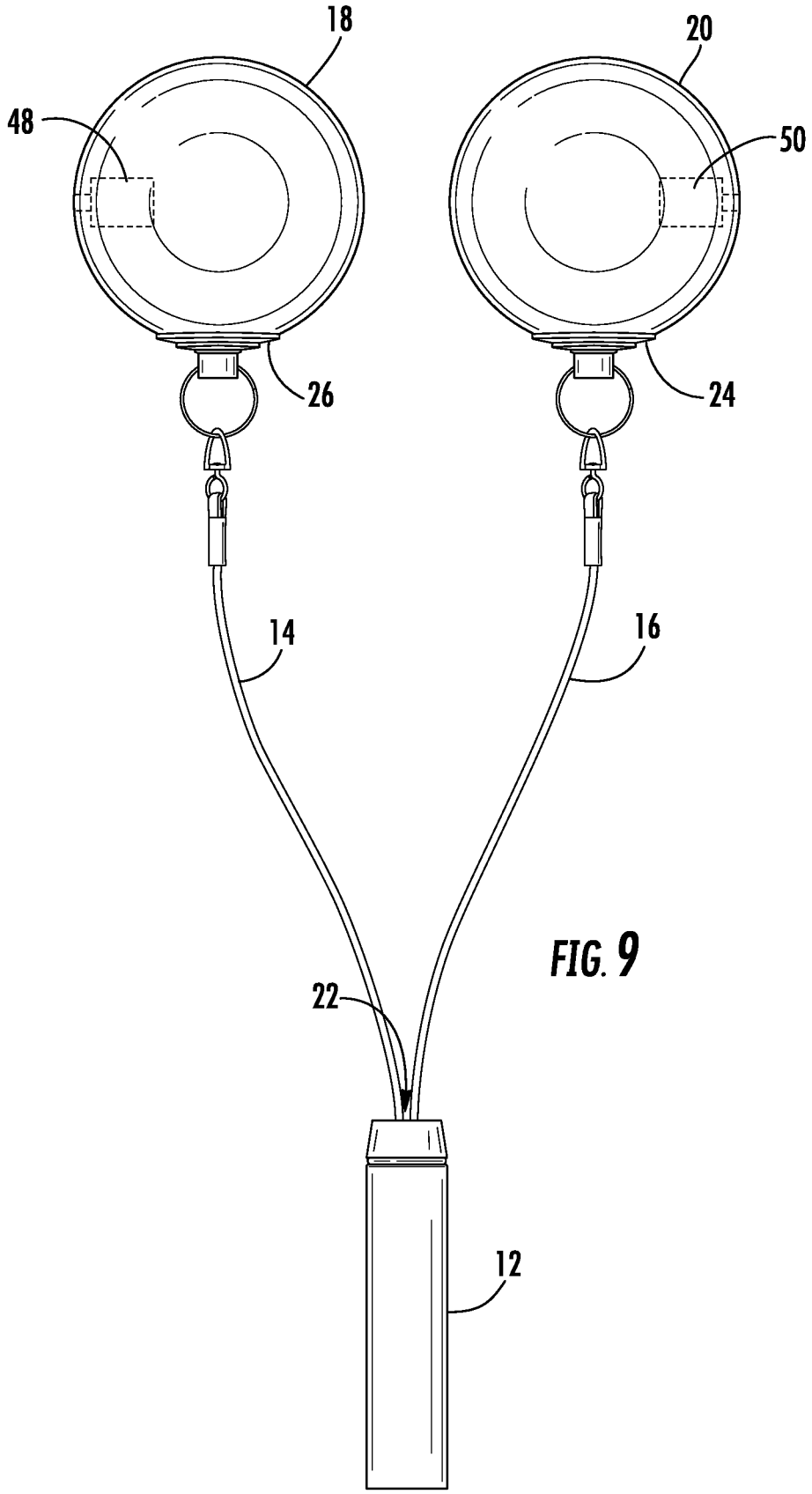
FIG. 9 is a first side view of the tethered ball toy depicted in FIG. 1, illustrating, in particular, the handle, the first and second tethers, first and second rings, first and second swivels, first and second clasps, swivel cylinder, first and second balls, and first and second lights within the two balls.
Figure 10:
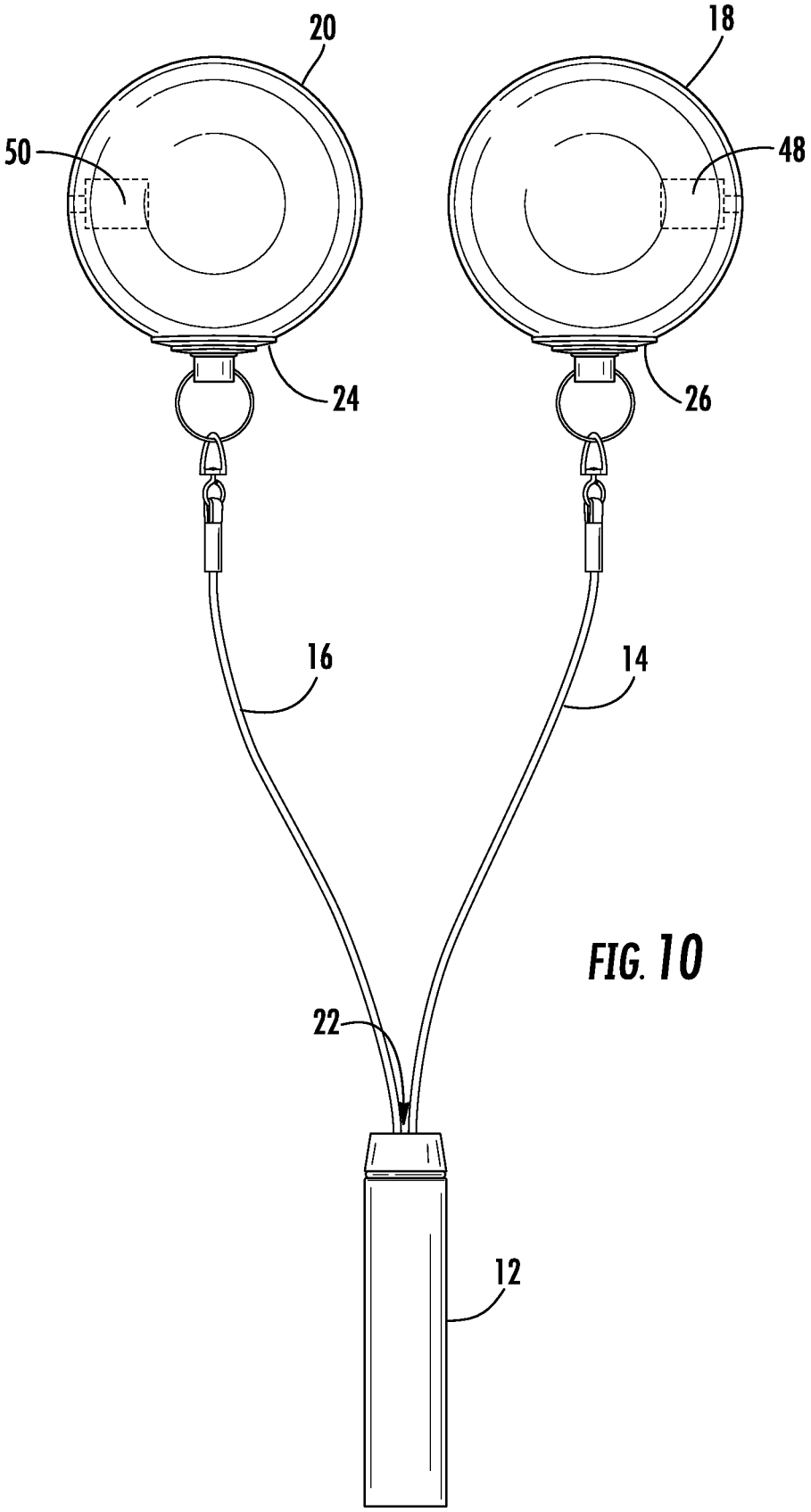
FIG. 10 is a second side view of the tethered ball toy depicted in FIG. 1, illustrating, in particular, the handle, the first and second tethers, first and second rings, first and second swivels, first and second clasps, swivel cylinder, and the first and second balls, and first and second lights within the two balls.
Figure 11:
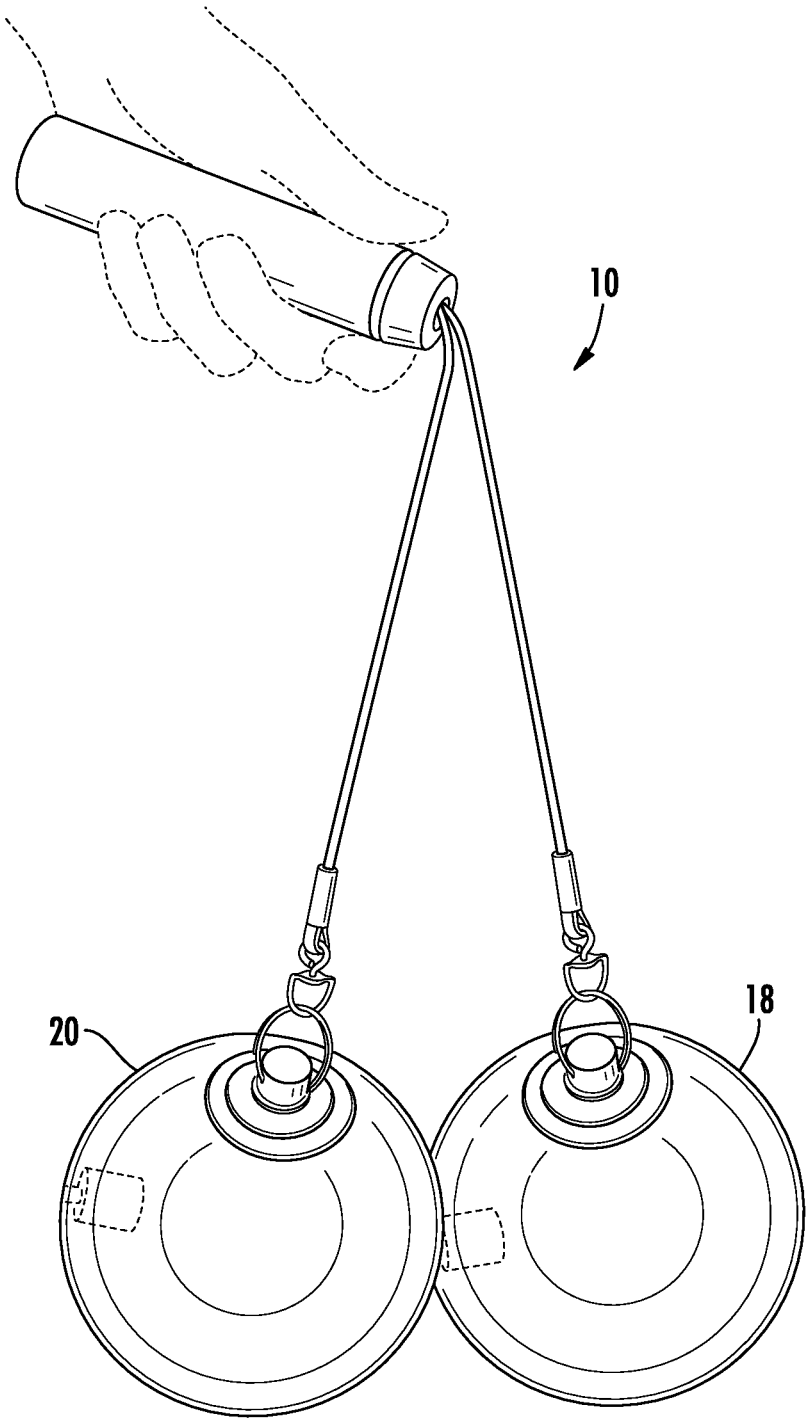
FIG. 11 is a front perspective view of the tethered ball toy depicted in FIG. 6, illustrating, in particular, the two suspended balls each having a light within configured to illuminate upon impact, held by a user and in a position of rest.
Figure 12:
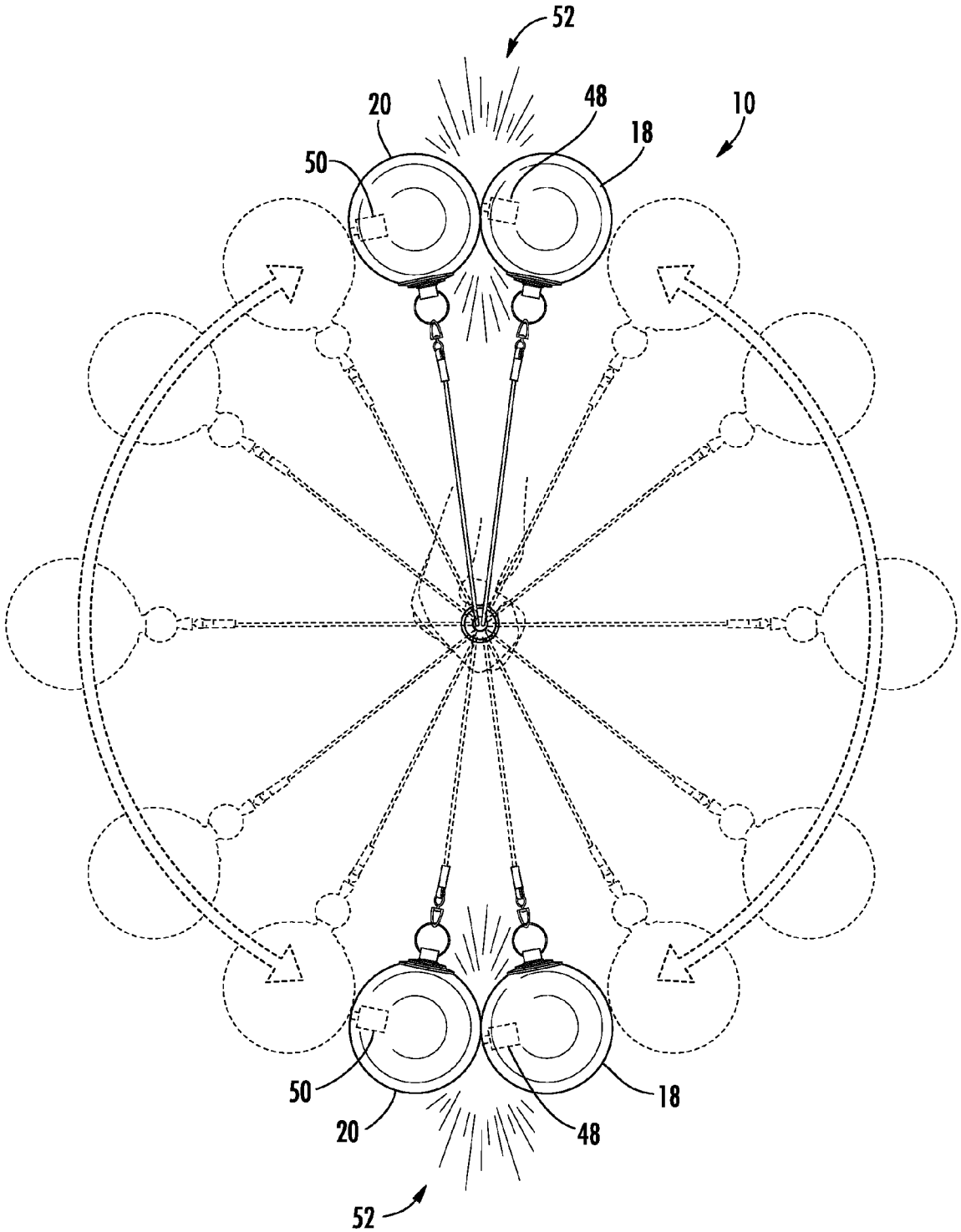
FIG. 12 is front perspective view of the tethered ball toy depicted in FIG. 6, illustrating, in particular, the two suspended balls each having a light within configured to illuminate upon impact, held by a user and in a position motion, specifically illustrating one example pattern of motion of the two balls and in which the illumination occurs upon impact of the two balls, according to an embodiment of the technology described herein.

Referring now to the FIGS. 1 through 12, a tethered ball toy 10 is shown. The tethered ball toy 10 is configured to provide amusement safely to both the operator and any onlooker. The tethered ball toy 10 also is configured to provide an optical illusion while in use and while remaining in motion. The tethered ball toy 10 further is configured as a noise making device as the balls 18, 20 of the device collide at various intervals in a circular pattern formed by the movement of the balls 18, 20. The tethered ball toy 10 further is adapted to provide amusement to children, but is designed to be safe and fun for persons of all ages.

The tethered ball toy 10 includes a handle 12. In various embodiments the handle is five to six inches in length, ten to twelve inches in length, or alternative desired lengths. In at least one embodiment, the handle is one half to one inch in diameter. In at least one embodiment, the handle 12 is generally a long cylindrical shape. In at least one embodiment, one or more ends of the handle 12 are rounded. However, upon reading this disclosure, it will be apparent to one of ordinary skill in the art, that the length, width, and overall configuration and shape of the handle 12 can vary according to the intended user, the desired amusement effect of the tethered ball toy 10, and other factors. Additionally, the handle 12 can be created in a variety of colors or a combination of colors suitable for a toy.

The handle 12 can include a cavity 22. The cavity 22 is the interior portion of the handle 12 to hold the tethers 14, 16, described below. In at least one embodiment, the cavity 22 includes a rotatable, swivel cylinder 28 within the handle 12. The swivel cylinder 28 is disposed within the cavity 22 of the handle 12 and opens at a distal end of the handle. In this embodiment, a stop can be utilized to temporarily disallow the rotation of the cavity 22 within the handle 12.

The swivel cylinder 28 is configured to receive a proximal end of the at least one tether 14, 16, and configured to allow rotation of the at least one tether 14, 16 within the handle. In at least one embodiment, the cavity 22 is fixed and thus not rotatable. In at least one embodiment, the cavity 22 is only large enough to securely hold the tethers 14, 16 to the handle 12.

In at least one embodiment, the tethered ball toy 10 also includes a hollow end 30 disposed at the proximal end of the handle 12. This configuration provides that the at least one tether 14, 16 is able to be pulled through the hollow end 30 of the handle 12 to adjust a length of the at least one tether 14, 16.

Additionally, the handle 12 can include a grip. The grip can be foam, rubber, or the like, to provide a cushioning to the hand of the operator. The grip can includes ridges and valleys contoured and suitable for receiving a hand of the operator. The grip can be created in a variety of colors or a combination of colors suitable for a toy.

The tethered ball toy 10 includes a first tether 14 and a second tether 16. In at least one embodiment, the first tether 14 and the second tether 16 are of equal length. In at least one embodiment, the first tether 14 and the second tether 16 are twelve inches in length. In at least one embodiment, the first tether 14 and the second tether 16 are opposite ends of the same tether cord, the balance of the cord stored within the cavity 22 of the handle 12. However, upon reading this disclosure, it will be apparent to one or ordinary skill in the art, that the length of the first tether 14 and the second tether 16 can vary according to the intended user, the desired amusement effect of the tethered ball toy 10, and other factors.

In at least one embodiment, the first tether 14 and the second tether 16 are comprised of a synthetic cord. In at least one embodiment, the first tether 14 and the second tether 16 are comprised of nylon. In at least one embodiment, the first tether 14 and the second tether 16 are comprised of a material that provides for some recoil, such as rubber. The first tether 14 and the second tether 16 can be created in a variety of colors or a combination of colors suitable for a toy.

The first tether 14 and the second tether 16 are coupled to the handle 12 at the cavity 22. The cavity 22 is an inner portion of the handle 12 wherein the first tether 14 and the second tether 16 are coupled. However, upon reading this disclosure, it will be apparent to one or ordinary skill in the art, that the length of the first tether 14 and the second tether 16 can be manufactured of alternative materials so long as they can securely hold the first ball 18 and the second ball 20 to the handle 12. Additionally, the lengths of the first tether 14 and the second tether 16 are variable if the operator seeks to secure them at a higher level within the cavity 22. However, the lengths chosen for each of the first tether 14 and the second tether 16 should be the same in order to provide for the collider effect of the first ball 18 and second ball 20, described below.

The tethered ball toy 10 includes a first ball 18 and a second ball 20. In at least one embodiment, the first ball 18 and the second ball 20 are comprised of plastic. In at least one embodiment, the first ball 18 and the second ball 20 are between 4 to 5 inches in diameter, but the ball size is variable. In at least one embodiment, the first ball 18 and the second ball 20 are comprised of rubber. However, upon reading this disclosure, it will be apparent to one or ordinary skill in the art, that the first ball 18 and the second ball 20 can be manufactured in other sizes and manufactured of other suitable materials so long as the material selected is safe from cracking or other adverse effects of ball collision, such as the crack and shatter of acrylic balls upon impact.

In at least one embodiment, the first ball 18 and the second ball 20 are configured to contain an inert gas, such as helium. Varying the gas contained within the first ball 18 and the second ball 20 alters their relative weight. The gas selected can vary and is selected from a list of safe gases.

In at least one embodiment the first ball 18 and the second ball 20 are manufactured of a material that is impervious to an inert gas contained within.

In at least one embodiment the first ball 18 and the second ball 20 are manufactured with a bladder within to securely hold the inert gas.

In at least one alternative embodiment the first ball 18 and the second ball 20 are manufactured with more than one bladder, such that different gases can be inserted into the same ball. In at least one alternative embodiment the first ball 18 and the second ball 20 are manufactured as solid balls.

The first ball 18 and the second ball 20 are configured to make a noise upon impact as they collide into one another. As the necessary motion of the handle 12 is learned from repeated practice by the operator, the first ball 18 and the second ball 20 collide at two points within a 360 degree circle. The two points of collision are opposite one another on the circle defined by the rotation of the first ball 18 and the second ball 20. Dependent on the material selection of the first ball 18 and the second ball 20, the type of impact noise made and the volume of the noise made can be varied.

The tethered ball toy 10 includes a first fastener 26 and a second fastener 24. The first fastener 26 and the second fastener 24 are configured to securely hold the first ball 18 and the second ball 20, respectively. In at least one embodiment, the first fastener 26 and the second fastener 24 are disposed upon the surface of the first ball 18 and the second ball 20, respectively. In at least one alternative embodiment, the first fastener 26 and the second fastener 24 are disposed within an interior portion of the first ball 18 and the second ball 20, respectively.

In at least one embodiment, the tethered ball toy 10 also includes a first ring 34 and a second ring 32. The first ring 34 is configured to be coupled to the first fastener 26. The second ring 32 is configured to be coupled to the second fastener 24. The first ring 34 and the second ring 32 provide an additional means of coupling as well as provide additional freedom of movement in operation of the tethered ball toy 10 as the balls 18, 20 are moved and impacted.

In at least one embodiment, the tethered ball toy 10 further includes a first ring channel 46 and a second ring channel 44. The first ring channel 46 is disposed within the first fastener 26 and is configured to receive the first ring 34. The second ring channel 44 is disposed within the second fastener 24 and is configured to receive the second ring 32.

In at least one embodiment, the tethered ball toy 10 also includes a first swivel 38 and a second swivel 36. The first swivel 38 is coupled to the first ring 34 at a distal end of the first swivel 38 and is coupled to the at least one tether 14 at a proximal end of the first swivel 38. The second swivel 36 is coupled to the second ring 32 at a distal end of the second swivel 36 and is coupled to the at least one tether 16 at a proximal end of the second swivel 36. The first swivel 38 and the second swivel 36 provide an additional means of coupling as well as provide additional freedom of movement in operation of the tethered ball toy 10 as the balls 18, 20 are moved and impacted.

In at least one embodiment, the tethered ball toy 10 further includes a first clasp 42 and a second clasp 40. The first clasp 42 is coupled to a first end of the at least one tether 14 and is configured to securely hold the first end looped through the first swivel 38. The second clasp 40 is coupled to a second end of the at least one tether 16 and is configured to securely hold the second end looped through the second swivel 36.

In at least one embodiment, the tethered ball toy 10 also includes a first light 48 and a second light 50. The first light 48 is disposed within a first ball 18 of the pair of tethered balls. The second light 50 is disposed within a second ball 20 of the pair of tethered balls. The first and second lights 48, 50 are configured to illuminate upon impact when, while the tethered ball toy 10 is in use, the first ball 18 and the second ball 20 collide, such that upon collision the impact causes the lights to illuminate 52.

In use, and in at least one embodiment, the tethered ball toy 10 is practiced by repeatedly raising and lowering the handle 12 in a learned pattern that commences with a slight raising and lowering and then accelerates to a faster raising and lowering, thus causing the first ball 18 and the second ball 20 to move. As the motion of the handle 12 continues with a practiced and acquired level of skill, the first ball 18 and second ball 20 will "collide" into one another.

If one were to equate the motion of the tethered ball toy 10 to a clock face, the first ball 18 and the second ball 20 are at rest at the six o'clock position when the handle 12 is held but not yet placed in motion. As the handle 12 is repeatedly raised and lowered in a learned pattern, that commences with a slight raising and lowering and then accelerates to a faster raising and lowering, the first ball 18 and the second ball 20 move upwardly, the first ball 18 toward the 5, 4, 3 o'clock positions, and so forth, and the second ball 20 toward the 7, 8, 9 o'clock positions and so forth. As the acceleration of tethered ball toy 10 continues the first ball 18 and second ball 20 will ultimately reach the 12 o'clock, at which point they will collide and knock each other.

Upon collision the first ball 18 and the second ball 20 will immediately reverse course and downwardly retrace the path they took upwardly. The first ball 18 and the second ball 20 will then collide again at the six o'clock position. The repeating motion and collision pattern will continue so long as the handle 12 of the tethered ball toy 10 is kept in the appropriate learned motion.

The repeating motion and collision pattern of the tethered ball toy 10 will also provide an optical illusion to the eyes as the motion of the balls 18, 20 is very rapid. The illusion effect can leave one with the impression of a rotating ring, or of a continuous loop.

It is to be understood that the disclosure teaches just one example of the illustrative embodiment and that many variations of the invention can easily be devised by those skilled in the art after reading this disclosure and that the scope of the present invention is to be determined by the claims.

What is claimed is:

1. A tethered ball toy comprising:

a handle;

at least one tether coupled to the handle;

a cavity disposed within the handle and configured to receive a proximal end of the at least one tether, and configured to receive and store within the handle any excess length of the at least one tether;

a hollow end disposed at the proximal end of the handle, such that the at least one tether is able to be pulled through the hollow end of the handle to adjust a length of the at least one tether;

a rotatable swivel cylinder disposed within the cavity of the handle and opening at a distal end of the handle, configured to receive a proximal end of the at least one tether, and configured to rotate within the cavity of the handle and thereby allow rotation and spin of the at least one tether within the handle as the rotatable swivel cylinder spins within the handle; and a pair of tethered balls coupled to the at least one tether and suspended from a distal end the handle, each ball configured as hollow and inflatable with a gas, each ball tethered at equal distance along the at least one tether to the handle, and each ball configured to be set in motion by a continuous movement of the handle and subsequently to collide with one another, thereby remaining in motion through a basic level of acquired skill in use of the tethered ball toy.

2. The tethered ball toy of claim 1, wherein the at least one tether further comprises a pair of tethers, a first tether to tether a first ball to the handle, and a second tether to tether a second ball to the handle.

3. The tethered ball toy of claim 1, wherein the handle further comprises a hand grip.

4. The tethered ball toy of claim 1, further comprising:

a first fastener and a second fastener, each fastener disposed upon and configured to securely hold one of the pair of tethered balls and couple to an end of the at least one tether.

5. The tethered ball toy of claim 4, further comprising:

a first ring and a second ring, each ring coupled to one of the first fastener and the second fastener.

6. The tethered ball toy of claim 5, further comprising:

a first ring channel and a second channel, the first ring channel disposed within the first fastener and configured to receive the first ring, and the second ring channel disposed within the second fastener and configured to receive the second ring.

7. The tethered ball toy of claim 4, further comprising:

a first swivel and a second swivel, the first swivel coupled to the first ring at a distal end of the first swivel and coupled to the at least one tether at a proximal end of the first swivel, the second swivel coupled to the second ring at a distal end of the second swivel and coupled to the at least one tether at a proximal end of the second swivel.

8. The tethered ball toy of claim 7, further comprising:

a first clasp and a second clasp, the first clasp coupled to a first end of the at least one tether and configured to securely hold the first end looped through the first swivel, the second clasp coupled to a second end of the at least one tether and configured to securely hold the second end looped through the second swivel.

9. The tethered ball toy of claim 4, further comprising:

a first light and a second light, the first light disposed within a first ball of the pair of tethered balls, the second light disposed within a second ball of the pair of tethered balls, the first and second lights configured to illuminate upon impact when, while the tethered ball toy is in use, the first ball and the second ball collide, such that upon collision the impact causes the lights to illuminate.

10. The tethered ball toy of claim 1, wherein the at least one tether comprises a synthetic cord.

11. The tethered ball toy of claim 1, wherein the handle is defined as generally a long cylindrical shape having a grip.

12. The tethered ball toy of claim 1, wherein the pair of tethered balls comprises a first ball and a second ball, each ball comprised of plastic.

13. The tethered ball toy of claim 1, wherein the pair of tethered balls comprises a first ball and a second ball, each ball comprised of rubber.

14. The tethered ball toy of claim 1, wherein the pair of tethered balls comprises a first ball and a second ball, each ball hollow and filled with compressed air.

15. The tethered ball toy of claim 1, wherein the pair of tethered balls comprises a first ball and a second ball, each ball hollow and filled with helium.

16. The tethered ball toy of claim 1, wherein the pair of tethered balls comprises a first ball and a second ball, each ball hollow and comprising a bladder, wherein the bladder is filled with a first inter gas, and wherein an area surrounding the bladder and within the ball is filled with a second inert gas.

17. The tethered ball toy of claim 1, wherein the tethered ball toy is configured as a noise making device as the pair of tethered balls collide at various intervals in a circular pattern formed by the movement of the handle and balls.

* * * * *